US005645415A

United States Patent [19]

Hamel

[11] Patent Number: 5,645,415

[45] Date of Patent: Jul. 8, 1997

[54] CHILD-PROOF GAS LIGHTERS AND PENS THEREWITH

[76] Inventor: Gilles Hamel, 8 Place Morley, Tourraine, Qc, J6Z 3A6, Canada

[21] Appl. No.: 581,215

[22] Filed: Dec. 29, 1995

Related U.S. Application Data

[63] Continuation-in-part of Ser. No. 490,199, Jun. 14, 1995.

[51] Int. Cl.[6] ..... F23D 11/36

[52] U.S. Cl. ..... 431/153; 431/277; 401/195

[58] Field of Search ..... 431/153, 277; 401/195

[56] References Cited

U.S. PATENT DOCUMENTS

| | | | |
|---|---|---|---|
| 5,002,482 | 3/1991 | Fairbanks et al. | 431/277 |
| 5,074,781 | 12/1991 | Fujita | 431/277 |
| 5,224,854 | 7/1993 | Ansquer | 431/277 |
| 5,288,226 | 2/1994 | Khemarangsan | 431/277 |

FOREIGN PATENT DOCUMENTS 2130799 2/1993 WIPO .

*Primary Examiner*—Carl D. Price
*Attorney, Agent, or Firm*—Antoine H. Gauvin

[57] ABSTRACT

A child-proof gas lighter has a lever operating a gas valve, for opening and closing the gas valve in an open and close position. An interfering piece is movably mounted on the lighter, in space relation to the lever. That interfering piece has a portion for jamming the lever, as to prevent displacements of that lever for opening the valve when moving in one direction. When moving the interfering piece counter to that direction, the lever becomes displaceable in that open position, to allow opening of the valve, thus the interfering piece is displaceable from an open unlock position to a close lock position. A retractable pen having such lighters is also described.

20 Claims, 4 Drawing Sheets

CHILD-PROOF GAS LIGHTERS AND PENS THEREWITH

BACKGROUND OF THE INVENTION

1. Field of the Invention

This application is a continuation-in-part of U.S. application Ser. No. 08/490,199 dated Jun. 14, 1995. This invention relates to a child-proof gas-lighter having security features on gas reservoir, and preferably also on striker wheels when gas-lighters have such a wheel, and to pens provided with such gas-lighters.

2. Description of Related Art

As far as Applicant is aware, retractable pen are well known, for instance it is described in U.S. Pat. No. 3,679, 318 dated Jul. 25, 1972 as invented by Liguori. However, when used for writing, their points have a tendency to retract. No device is known for releasably locking the refill when in the writing position.

Petrol cigar lighters having a writing implement are also known and have been described for instance in Canadian Patent 500,066, dated Feb. 16, 1954, as invented by Harris et al.

A particular child-proof gas lighter has also been described in Canadian Patent 2,130,799 published Aug. 26 1993, as invented by Frigiers.

SUMMARY OF THE INVENTION

Broadly stated the invention is directed to a child-proof gas lighter comprising:

a gas reservoir, said gas reservoir having a gas valve, a lever having one end and another end, and a pivot therebetween said ends, in order to enable rocking of said lever, said gas valve being operatively connected to one end of said lever, for opening and closing said gas valve in an open and close position, a means for biassing said lever toward said close position, in space relation to said gas valve, a means for igniting gas from said gas valve, an interfering piece rotatably mounted on said lighter, in space relation to said lever, said interfering piece upon rotation in one direction having a portion displaceable toward said lever, for contacting said portion of said interfering piece against said lever to jam said lever, and to prevent displacements of said lever for opening said valve, when rotating in one direction, and upon rotating said interfering piece counter to said one direction, said portion of said interfering piece, being displaceable away from said lever, and said lever becoming displaceable into said open position allowing opening of said valve, thus said interfering piece being rotatably displaceable from an open unlock position to a close lock position, a means for biassing said interfering piece toward said one direction, to induce rotation of said interfering piece toward said direction.

In a particular embodiment, the invention aims at pens provided with a child-proof lighter which requires, in order to be operable, turning of a locking wheel which is spring loaded, sliding a pen-clip operating a spring loaded lever actuating a valve of a gas source, then actuating a striker wheel, and this with the minimum structure requirement.

This operation requires to be repeated each time, after each opening of the valve of the gas source with the pen-clip, which resets the locking wheel to the lock position, thereby locking the gas source and to such pens overcoming withdrawal of a retractable pen, while writing.

In a particular embodiment the invention is directed to a child-proof gas lighter comprising:

a gas reservoir, said gas reservoir having a gas valve, a spring-loaded lever having one end and another end, said gas valve being operatively connected to one end of said spring-loaded lever, pivotally connected to the other end of said spring-loaded lever, a pen-clip having a top, said spring of said spring-loaded lever urging closing of said gas valve, a spring-loaded, locking, open ring rotatably mounted over a portion of said pen-clip, and covering a portion of said pen-clip, as to prevent sliding of said pen-clip for opening said gas valve, upon rotation of said spring-loaded, locking, open ring, the open portion of said ring being able to be in phase over said portion of said pen-clip, in order to allow the pen-clip through to allow opening of said gas valve, the spring of said spring-loaded, locking, open ring urging positioning of the open portion of said open ring out of phase with said portion of said pen-clip, as to be in a lock position, whereby on turning the spring-loaded, locking, open ring to align that open portion, with the pen-clip, the pen-clip becomes displaceable in that open portion of the spring-loaded, locking, open ring, to open the gas valve, once the pen-clip is actuated to close the gas-valve, the spring-loaded, locking, open ring is urged to return to said lock position, by said spring of said spring-loaded, locking, open ring, adjacent to said gas valve, a rotatably mounted striker wheel is operatively connected to a spring loaded flint.

The invention is preferably directed to a retractable pen having a child-proof gas lighter, said pen having means to lock-in the point of the pen, when in extended position for writing, comprising:

an upper tubular portion, and a lower tubular portion, each of said upper tubular portion and lower tubular portion having inner and outer walls, and a longitudinal axis, and said lower tubular portion being rotatably mounted to said upper tubular portion, said lower tubular portion terminating into a truncated conic end, said truncated conic end having inner wall, said upper tubular portion having, adjacent to said lower tubular portion, a partition defining in said lower tubular portion, a helicoid path rotating less than 350 degrees and moving in the direction of a line inclined about 45±10 degrees, and terminating in its lowermost surface into an anchor-plate initially moving in the direction of a line inclined about 155±15 degrees, so as to define a shoulder between said helicoid path and said anchor-plate, said lower tubular portion having mounted therein an ink tube having one end and another end, and at said one end receiving a member for positioning said ink tube, said member for positioning said ink tube, having a top, and being slidably mounted to said inner wall of said lower tubular portion in order to slide the other end of said ink tube, in and out of said truncated conic end, and said top of said member for positioning said ink tube, having a periphery, said member for positioning said ink tube, at its top, being provided with a runner for engaging said helicoid path, and said anchor-plate of said helicoid path, and be releasably held therewith, a spring to urge against said member for positioning said ink tube, in order for said runner to push against said helicoid path, for positioning said ink tube at a desired position, for maintaining said ink tube, within and out of said truncated conic end, whereby upon rotation in one direction, of said lower tubular portion with respect to said upper tubular portion, said helicoid path pushes said runner, until said runner is releasably held by said anchor-plate, and thereby said other end of said ink tube is out of said truncated conic end, ready for writing, and upon rotation counter to said one direction said runner in said path allows said other end of said ink tube to return within said truncated conic end, and said upper tubular portion further comprising:

a gas reservoir defined in said upper tubular portion, said gas reservoir having a gas valve, a spring-loaded lever having one end and another end, said gas valve being operatively connected to one end of said spring-loaded lever, a pen-clip slidably mounted onto said outer wall of said upper tubular portion and pivotally connected to the other end of said spring-loaded lever, said pen-clip having a top, said spring of said spring-loaded lever urging closing of said gas valve, a spring-loaded, locking, open ring rotatably mounted about said outer wall of said upper tubular portion, and covering the top of said spring-loaded, locking, open ring, as to prevent sliding of said pen-clip, the spring of said spring-loaded, locking, open ring, urging positioning of said open ring in a lock position, the open portion of the spring-loaded, locking, open ring being such as to allow the pen-clip through, whereby on turning the spring-loaded, locking, open ring to align that open portion, with the pen-clip, the pen-clip becomes displaceable in that open portion of the spring-loaded, locking, open ring, to open the gas valve, once the pen-clip is actuated to close the gas-valve, the spring-loaded, locking, open ring is urged to return to said lock position, by said spring of said spring-loaded, locking, open ring, adjacent to said gas valve, a rotatably mounted striker wheel is operatively connected to a spring loaded flint.

Further embodiments of the invention will be described herein below.

DESCRIPTION OF THE DRAWINGS

In the drawings which illustrate some of the preferred ways of carrying out the invention.

DESCRIPTION OF SOME OF THE PREFERRED WAYS OF CARRYING OUT THE INVENTION

The Pen

Figure 1:
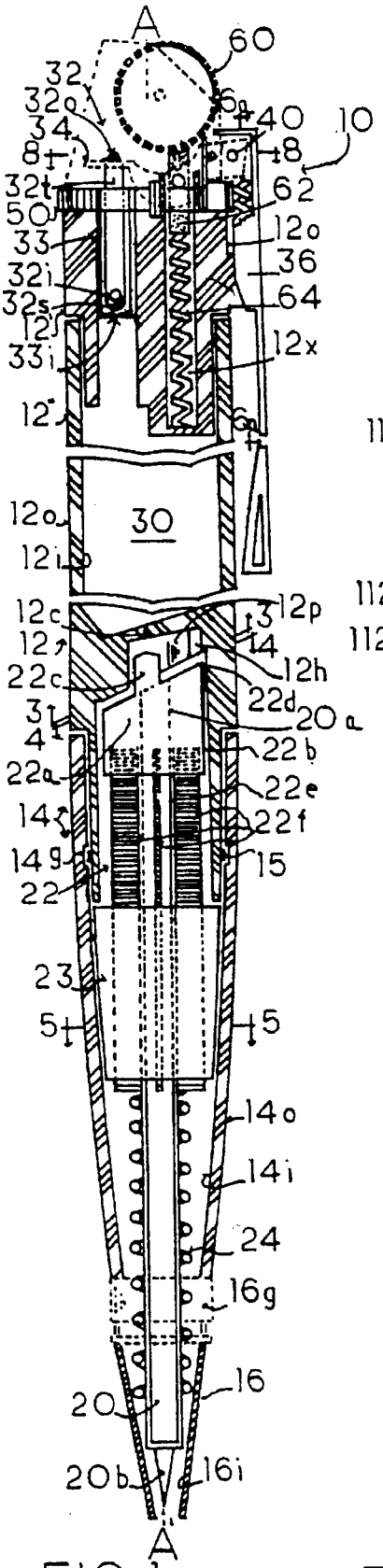
FIG. 1 is a cross-section view of a retractable pen having a child-proof gas lighter, with the point of the pen in the retracted position, the cross-section view having portions of a gas reservoir and of a pen-clip partly cut-out.
Figure 2:
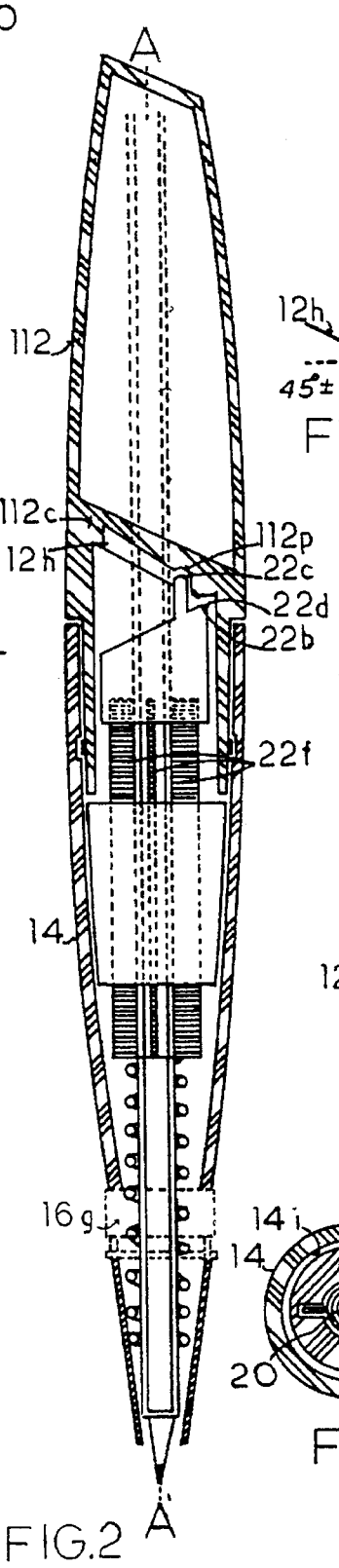
FIG. 2 is a cross-section view of a portion of the retractable pen gas lighter shown in FIG. 1, but with the point of the pen in the extended position and in a version without gas lighter.

As shown in FIGS. 1 and 2, a retractable pen 10 having a child-proof gas lighter in FIG. 1, comprises an upper tubular portion 12, and a lower tubular portion 14 rotatably mounted to said upper tubular portion. The upper tubular portion and the lower tubular portion have each an inner wall 12*i*, 14*i* and an outer wall 12*o* and 14*o* respectively, and a common longitudinal axis partly shown along A–A'.

One of the simplest ways to establish the rotation is to enable one end one of the two portions to be mounted, over or under, one end of the other portion of the two portions, and to receive therebetween said two portions 12, 14 a retaining O-ring 15, at least one of the two portions having a annular groove, such as 14*g*, for receiving a portion of said O-ring as shown in FIG. 1, and confining said O-ring inside said groove 14*g*. These two portions 12, 14 may conveniently be plastic molded.

The lower tubular portion 14 terminates into a truncated conic end 16, that truncated conic end 16 has inner wall 16*i*; that truncated conic end may be fixedly mounted to said lower tubular portion 14 with a circular tightening sleeve 16*g* as shown in FIG. 1, be threadedly mounted, or be integral therewith. Also as shown in FIG. 1, if desired, that lower tubular portion 14 may be tapered: gradually tapering toward that truncated conic end.

The upper tubular portion 12, adjacent to the lower tubular portion 14, has a partition 12*c* closing the upper tubular portion 12 from the lower tubular portion 14, and defining, in the lower tubular portion, a helicoid path 12*h*, concentric with the axis of symmetry A–A', rotating less than 350 degrees (FIG. 3), and moving in the direction of a line inclined about 45±10 degrees, and terminating in its lowermost surface into an anchor-plate 12*p* (FIGS. 2, 3, 3*a*) initially moving in the direction of a line inclined about 155±15 degrees, so as to define a shoulder between said helicoid path and said anchor-plate.

The lower tubular portion 14 has mounted therein an ink tube 20 having one end 20*a* and another end 20*b*, and at the one end 20*a* receiving a member 22 for positioning the ink tube.

Figure 5:
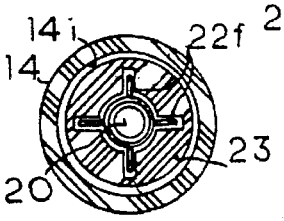
FIG. 5 is a view taken along line 5—5 of FIG. 1.
Figure 4:
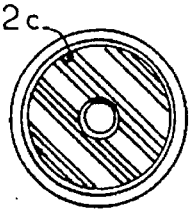
FIG. 4 is a view taken along line 4—4 of FIG. 1.

The member 22 for positioning the ink tube, has a top 22*a*. The centering of the ink tube, is accomplished by providing the member 22 for positioning the ink tube, with a central ink-tube housing 22*e* receiving the ink tube, and by projections or peripheral fins 22*f*, at least extending partially along the periphery of said member 22. As seen in FIG. 5, these fins 22*f* are slidably mounted inside a corresponding complementary sleeve 23 press fit, and running against the inner wall 14*i* of the lower tubular portion, in order to slide the other end 20*b* of the ink tube 20, in and out of the truncated conic end 16, and to centre said ink tube 20.

Preferably, the top of the member 22 for positioning the ink tube, is slanted: that is the slope of the top of the member 22 is substantially equivalent to the slope of the helicoid path, that is 45±10 degrees, and most preferably 45 degree; such that when the ink tube is in the truncated conic end 16, the top of the member 22 is substantially parallel to the partition 12*c*.

The top of said member 22 for positioning said ink tube, has a periphery 22*b*.

The member 22 for positioning the ink tube, at its top, is provided with a runner 22*c*, a pin for instance, for engaging said helicoid path 12*h*, and preferably with a shoulder 22*d* between the runner and the periphery of said top, for engaging the anchor-plate 12*p* of the helicoid path 12*h*, and thus be releasably held therewith.

A spring 24 is urged against the member 22 for positioning the ink tube, for maintaining said ink tube, within said truncated conic end, whereby upon rotation in one direction, of said lower tubular portion with respect to said upper tubular portion, said runner is pushed by said helicoid path 12*h* until it is releasably held by said anchor-plate 12*p*, and thereby said other end of said ink tube is out of said truncated conic end, ready for writing, thereby providing a retractable pen having means to releasably lock-in the point of a pen, when in extended position for writing, and upon rotation counter to said one direction said runner in said path allows said other end of said ink tube to return within said truncated conic end.

Figure 3A:
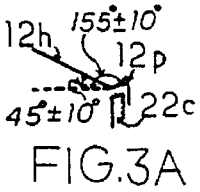
FIG. 3*a* is an elevation view taken along line 3*a*—3*a* of FIG. 3, illustrating the direction of the line inclined about 45 degrees of a portion of the helicoid path plate terminating into an anchor-plate and a runner engaging said anchor-plate.
Figure 3B:
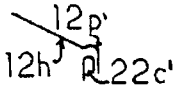
FIG. 3*b*, is an elevation view, similar to FIG. 3*a*, but illustrating another anchor-plate and another runner.
Figure 3C:
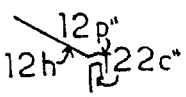
FIG. 3*c*, is an elevation view similar to FIG. 3*a*, but illustrating another anchor-plate and another runner.

The anchor-plate 12*p* needs not have the slanted ending configuration as shown in FIG. 3*a*, but a plethora of other configurations may be used: for instance as shown in FIG. 3*b*, a rounded inward configuration 12*p'*, for receiving a runner 22*c'* terminating into an outwardly rounded free end in order to engage said rounded inward configuration; or as shown in FIG. 3*c*, a conical inward configuration 12*p"*, for receiving a runner 22*c"* terminating into an outwardly rounded free end in order to engage said conical inward configuration.

Figure 3D:
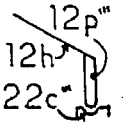
FIG. 3*d*, is an elevation view similar to FIG. 3*a*, but illustrating still another anchor-plate and another runner.
Figure 3:
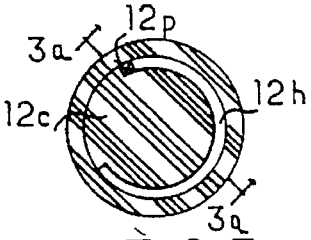
FIG. 3 is a view taken along line 3—3 of FIG. 1.

It should be noted that although as shown in FIG. 3*a*, 3*b* and 3*c*, the helicoid path 12*h* is a groove and the runner 22*c*, 22*c'* or 22*c'*, slides in said groove, instead that helicoid path may also be a projection 12*p'"*, and the runner 22*c'"* engaging said projection, as shown in FIG. 3*d*.

The Child-Proof Gas Lighter

As shown in FIGS. 1 and 7–10, the upper tubular portion comprises a gas reservoir 30 for a gas lighter, defined in the upper tubular portion 12, for instance a butane reservoir. In FIG. 1, a portion of the gas reservoir has been cut out, in order to have an enlarged, and thereby clearer views of other portions of the pen.

The gas reservoir has a gas valve 32: For instance a tubular member 32*t* terminating at the top into a conic end having a central aperture 32*o*, and at the bottom having a continuous flat bottom, and said tubular member along its periphery having another aperture 32*i*. This tubular member is slidably mounted in a housing 33 therefor, either molded, press fit or squeezed in, in order to be gas tight, and having a gas inlet 33*i*, such that the tubular member 32*t* is in gas-tight relation with the housing, and that the tubular member is slidably mounted therein. Thus under the pressure of the gas in the gas reservoir 30, the gas is displaced through the orifice 33*i*, and pushes against the flat bottom of the tubular member 32*t*, lifting the tubular member 32*t*, allowing the gas through the aperture 32*i*, inside the tubular member and through the central aperture 32*o*. The bottom of tubular member 32*t* needs not be flat, but should have a configuration to tight fit the orifice 33*i*. A rubber seal 32*s* is preferably provided on the bottom of the tubular member 32*t*.

A pivotally mounted, spring-loaded lever 34 has one end 34*a*, another end 34*b*, and a pivot 35 therebetween these ends. The pivot 35 is mounted into an opening 12*u* (FIG. 7) provided therefor, in the upper tubular portion 12.

The gas valve 32 is operatively connected to one end 34*a* of the spring-loaded lever 34, the spring-loaded lever 34 urges closing of said gas valve. The lever may have any other means for biassing it in the close position, in order to urge closing of the gas valve. Thus the lever 34 opens and closes said valve 32.

In a preferred embodiment, the pivotally mounted, spring-loaded lever 34 is preferably, provided with or defining, a protrusion or boss 34*c* sideways as will be discussed further herein below.

Figure 6:
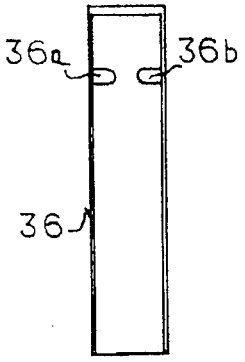
FIG. 6*a* is a rear view of the sliding clip, taken along line 6*a*—6*a* of FIG. 1.

When the child-proof gas lighter is provided with a pen, a pen-clip 36 is preferably slidably mounted onto the outer wall 12*o* of the upper tubular portion 12, and pivotally connected to the other end 34*b* of the spring-loaded lever, via pivot 40: Sliding of the pen-clip is obtained for example, by means of a slot 12*y*, provided the upper tubular portion 12, and by the pen-clip 36 being provided with bent tongues 36*a*, 36*b* (FIG. 6*a*) or other projections, whereby the tongues in the slot 12*y*, hold the pen-clip 36 against the upper tubular portion 12, and the slot simultaneously enables sliding of said tongues within said slot, and thereby sliding of said pen-clip 36, and thus enabling opening of said gas valve.

The spring 38 of the spring-loaded lever, urges closing of the gas valve.

Figure 8:
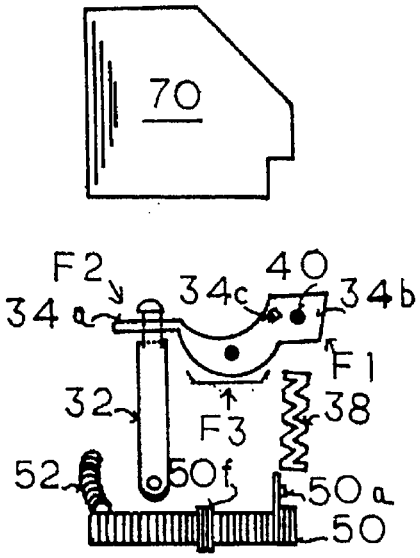
FIG. 8 is a cross-section view, as taken from line 8—8 of FIG. 1.
Figure 8:
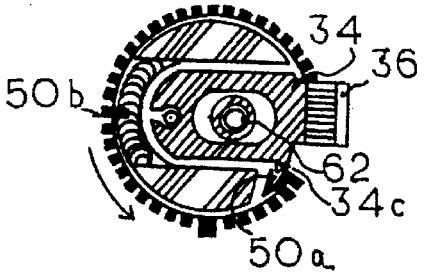
Figure 7:
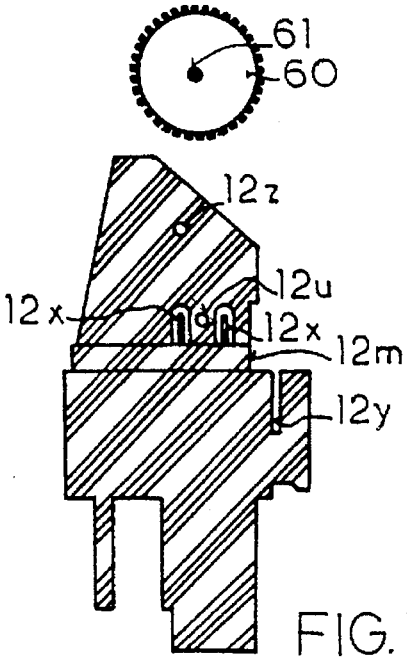
FIG. 7 is an exploded view of some of the components of the child-proof gas lighter of FIG. 1.
Figure 10:
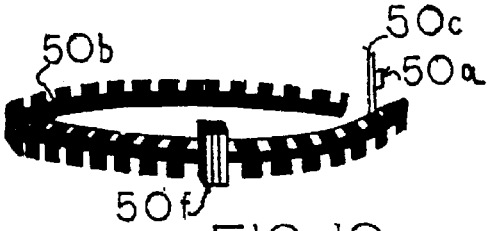
FIG. 10 is a perspective view of the interfering piece or locking open ring 50 of FIGS. 1 and 9*a;*

Among one of the preferred interfering pieces movably mounted on a lighter, in space relation to the lever, is a spring-loaded, locking, open ring 50, which has a lock positioning spring 52, biassing along the arrow as shown in FIG. 8, and is rotatably mounted about the outer wall 12*o* of the upper tubular portion 12, for instance about a rounded section 12*m* (FIG. 7). Other devices for biassing the open ring may also be used if desired.

In a preferred embodiment, that interfering piece which is this spring-loaded, locking, open ring 50, is provided with an arm outwardly projected therefrom, extending in space relation to said protrusion 34*c* of said lever: such as locking pin 50*c* having a projection 50*a* substantially perpendicular to the locking pin. The pin 50*c*, (better shown in FIG. 8), engaging against the protrusion 34*c* which may take various shapes, in a preferred embodiment, is correspondingly V-shaped or round in shape, that is having a triangular or rounded cross-section, in order to ensure clearance of the ends of the spring-loaded, locking, open ring or ring 50, that is the open portion, or the portion x of the ring 50 (FIG. 9*a*), which is open for the passage of the top of the pen-clip 36, (FIG. 8), but is also ensuring only one stroke of the pen-clip since after that single stroke, the top-portion of the pen clip is entrapped in the spring-loaded, locking, open ring 50, and thus locking the spring-loaded lever 34 and also the gas valve 32. A projection 50*b* engages the spring 52 for urging or biassing the open ring 50 in the lock position. Thus on acting counter to said one direction on said interfering piece, said arm, such as locking pin 50*c*, moves on one side of the protrusion to enable a gap between the portion of said interfering piece and the lever, and upon pressing the lever for opening said gas valve, the arm of said interfering piece, is released from the protrusion, to lean against the side of the lever, on the other side of the protrusion, thereby jamming the striker wheel and the lever.

The projections 50*a* and protrusion sideways 34*c* of the lever may take other forms; they may define each respectively, a boss or other projections the term: "protrusion" being meant to enclose them all.

Figure 9A:
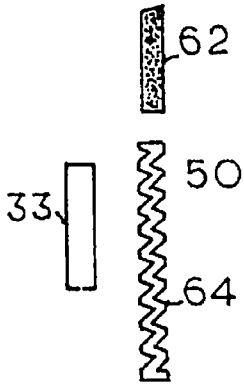
FIG. 9*a* is a top view of a locking open ring acting as one interfering piece movably mounted on the lighter, in space relation to said lever for jamming the lever.
Figure 9A:
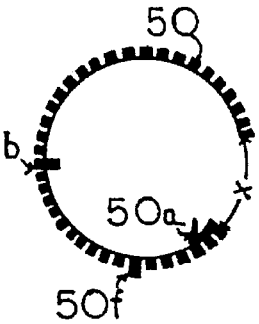

As shown in FIGS. 8 and 9*a*, the portion x of the ring 50 which is open, is such as to allow the pen-clip through, whereby on turning the open ring 50 to align that portion with the pen-clip 36, the pen-clip 36 is displaced in that portion of the ring which is open, opening the gas valve 32: that portion x corresponds to at least the width 36*x* of the pen-clip 36, plus a clearance. The spring-loaded, locking, open ring 50 once set to be aligned with the pen-clip, remains ready to receive the pen-clip, because the protrusion 34*c* withhold the locking pin 50*c*, but once the pen-clip is activated, the ring 50 is urged to return to the lock position, because the protrusion 34*c* becoming lower than the projection 50*a*, and no longer being withheld by that projection the locking pin leans against the side of the lever 34, as soon as the pen-clip closes the gas-valve 32, the ring 50 being ready to lock the lever as it returns into the close position. The ring 50 may be conveniently provided with a push-button 50*f*, that is a button for pushing the ring 50. Thus, the ring 50 is one of the interfering pieces which may be used, having a portion for jamming the lever, as to prevent displacements of that lever for opening the gas valve when moving in one direction, and upon moving the interfering piece counter to said direction, the lever being displaceable in the open position, to allow opening of the valve, thus the interfering piece being displaceable from an open unlock position to a close lock position, and having a means for biassing that interfering piece toward said one direction, to induce rotation of said interfering piece toward said direction.

Adjacent to the gas valve 32, and in space relation therewith, a rotatably mounted striker wheel 60 is pivotally mounted with pivot 61. This striker wheel 60 is preferably toothed. The striker wheel 60 is operatively connected to a spring loaded flint 62, with a spring 64 contained in a housing or casing 12*x* (FIGS. 1 and 11), defined within said tubular portion 12, said casing extending as shown into an outer peripheral portion at the top, and preferably circular, for urging said flint against said striker wheel, and stopping short of said striker wheel, as to obtain a child-proof lighter which requires, in order to be operable:

turning of a locking wheel 50 which is spring loaded, sliding a pen-clip 36 operating a spring loaded lever actuating a valve of a gas source, then actuating a striker wheel 60, and this with the minimum structure requirement. Other means of igniting gas from the gas valve are also contemplated, for example: an electric spark in space relation to the gas valve, from an electric condenser, though less preferred.

This operation requires to be repeated each time, after each opening of the valve of the gas source with the pen-clip, which resets the locking wheel to the lock position, thereby locking the gas source. This open ring 50 as shown in FIG. 9*a* is easily operated with a finger. Also ring 50 may be provided with a push-button 50*f*, if desired.

If desired, when the lighter has a striking wheel, the ring 50 may be provided with a locking pin 50*c* (FIG. 10), acting as a braking arm for engaging between two adjacent teeth of a toothed striker wheel 60, in order to also lock the striker wheel, thereby braking said striker wheel. The ring 50 may be metallic or plastic made of a high tensile strength. The portion of the locking pin in contact with the striker wheel may be circular in cross-section, or a wedge, or rectangular in cross-section, or toothed to mate with the teeth of the striker wheel.

Figure 9B:
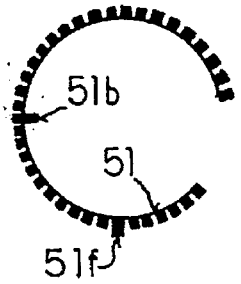
FIG. 9*b* is a top view of another locking open ring acting as one of said interfering pieces.

If desired as shown in FIG. 9*b*, instead of the ring 50, a spring-loaded, locking, open ring such as 51 may also be free of the projection 50*a*, and protrusion 34*c* in the spring-loaded lever 34: in such a case, the two hands are more likely needed for aligning the opening in the ring 50 with the pen-clip. A projection 51*b* engages the spring 52 for biassing the open ring 51 in the lock position, with or without a push-button 51*f*.

Figure 9C:
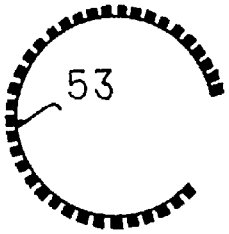
FIG. 9*c* is a top view of still another locking open ring acting as another interfering piece.

If desired as shown in FIG. 9*c*, the ring may also be free of any projection as shown in spring-loaded, locking, open ring 53, which is a regular open ring.

If desired, for manufacturing convenience, the upper or the lower tubular portion, or both portions 12 and 14 may be made segmented, as for instance as shown at 12' and 12" which cooperate to define the upper tubular portion 12.

Also the top of the lighter is conveniently provided with a cap 70.

If desired instead of a retractable pen having a gas lighter, the invention may be directed to a simple retractable pen as shown in FIG. 2. Instead of the upper tubular portion 112, adjacent to the lower tubular portion 14, has a partition 112*c* closing the upper tubular portion 112 from the lower tubular portion 14, and defining, in the lower tubular portion, a helicoid path 112*h*, concentric with the axis of symmetry A–A', rotating less than 350 degrees (FIG. 3), and moving in the direction of a line inclined about 45±10 degrees, and terminating in its lowermost surface into an anchor-plate 112*p* which is similar to 12*p*.

Figure 11:
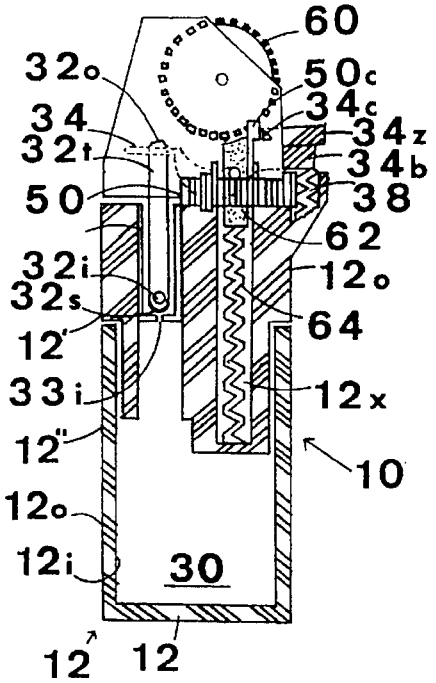
FIG. 11 is a cross-section view of a child-proof gas lighter without a pen, but with an interfering piece which is a locking open ring.
Figure 12:
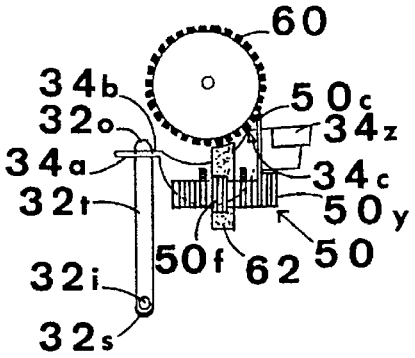
FIG. 12 is a side view of the striking wheel, the gas valve and the lever and the interfering piece cross-section view of a child-proof gas lighter without a pen.

As shown in FIGS. 11 and 12, a child-proof gas lighter 10 in FIG. 1, comprises a tubular portion 12. The tubular portion has an inner wall 12*i*, and an outer wall 12*o* and a partition 12*c* closing the lower portion of the tubular portion. This lighter need not be with a pen, and thus the slot 12*y* (FIG. 7), for sliding the pen-clip 36 is not needed. But preferably when no pen-clip actuates the lever, the other end 34*b*, of lever 34 is step-up as shown at 34*z* in FIGS. 12, 13 and 14. Thus, these Figures represent otherwise the same arrangement as in FIGS. 1 and 2, except for the absence of a pen and auxiliaries therefor. Also instead of the projection 50*a*, as clearly shown in FIGS. 11 and 12, the locking pin which remains of the same thickness through its length, is enlarged along its width, in the upper portion, that enlarged portion is for contacting one side of the protrusion 34*c* when the ring 50 is manually turned against the spring, for clearance, the ring 50 returns to rest against the protrusion 34*c*. On pressing the end 34*b* of the lever 34, the protrusion moves under the enlarged portion of the locking pin against the side of the lever which in returning to close the valve 32, will allow locking of the lever by the return of the ring 50 in the lock position. The enlarged portion withhold the action of the spring 52, when the ring 50 is turned against the spring 52. That enlarged portion is a mechanical equivalent to the projection 50*a* of FIGS. 10 and 9*a*, which has the same function. The height of the enlarged portion and of the protrusion 34*c* is simply a function of one another, and needs not near the top of lever 34. That arm, which is the locking pin in this particular case, need to be enlarged adjacent to the protrusion of the lever as to define an enlarged portion, whereby on acting counter to said one direction on said interfering piece, the enlarged portion of the arm, moves against one side of the protrusion to enable a gap between the portion of the interfering piece and the lever, and as the case may be, between the braking arm and the striker wheel, and upon pressing the lever for opening said gas valve, the protrusion slides away from the enlarged portion of said arm, the enlarged portion of said arm of said interfering piece, is thus released from the protrusion, to lean against the side of the lever, on the other side of the protrusion, thereby ready for jamming the lever, and if the case the striker wheel, when the lever returns to the close position.

The interfering piece movably mounted on the lighter, in space relation to the lever 34, may be the ring 50 as described above and shown in FIGS. 1–12, but needs not be. For instance, the interfering piece may be embodied in a polygonal piece having a straight or curved, or partly straight and partly curved periphery, including a spiral periphery, and wether in the form of a flat or be with step-up parts. That interfering piece may be rotatably mounted as shown in FIGS. 1–12, but may also rotatably mounted about a flint such as 62, or another pivot if desired, including a pivot rotatably mounted in the body of the lighter, for instance, outer wall 12.

Figure 13:
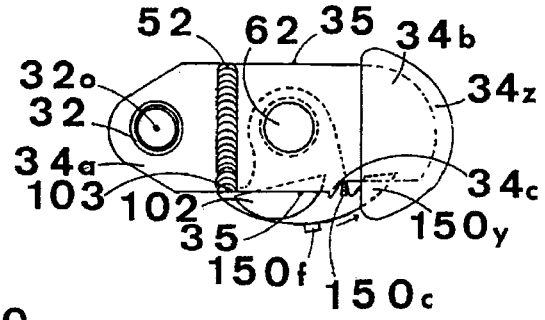
FIG. 13 is a top view of a lever, over another interfering piece jamming the lever in the closed position.
Figure 14A:
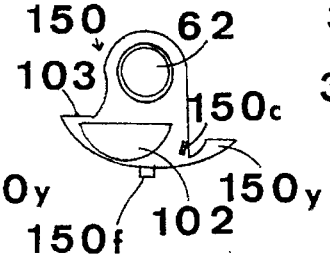
FIG. 14*a* is a top view of the interfering piece of FIGS. 13 and 14.
Figure 14:
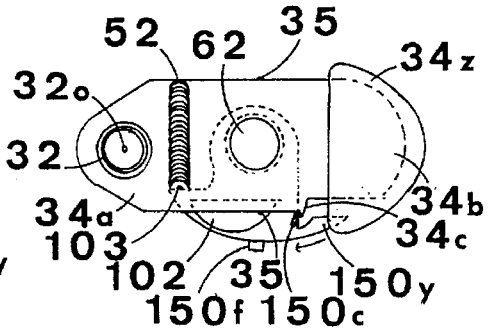
FIG. 14 is a top view similar to FIG. 13, but in the open position.

For instance as shown in FIGS. 13, 14, and 14*a*, the interfering piece 150 is a polygonal interfering piece having a periphery partly of a circle completed with straight lines, the center being perforated to rotate about the spring loaded flint 62, or more exactly as shown for instance in FIGS. 14*a*, 15*a*, 18 and 20, the interfering piece has a circular cut out portion, in order to be rotatably mounted about the outer peripheral portion of the casing such as 12*x*, for the flint, as shown in FIGS. 1 and 11, said interfering piece defining a segment-like of a flattened circular area bounded by a chord and a flattened arc of that circular area, and said circular cut out portion being off-center and diametrically opposed to said segment, said segment having one end defined by said chord and said arc, said one end defining said portion of said interfering piece; and being urged in the one direction with a side having a hook 103 to hook the spring 52, in order for said spring to exert a force as shown by the arrow of FIG. 13 for biassing the interfering piece in the direction for closing the gas valve. The interfering piece 150 has a portion 150*y*, for jamming the lever 34, by sliding thereunder the other end 34*b* of the lever 34, in order to prevent displacements of said lever for opening said valve when moving in one direction. Preferably, the interfering piece 150 is provided with a locking pin 150*c*, acting as a braking arm, similar to 50*c* of FIG. 10, when the lighter has a striking wheel.

Also the interfering piece 150 may be provided with a push-button 150*f*, if desired as already discussed for 50*f* of ring 50. The interfering piece 150 may also have perforations which do not materially affect the strength of the piece 150, for instance, a cut-out portion 102.

The interfering piece 150, when rotated as shown by the arrow in FIG. 14, removes the portion 150*y* of the interfering piece, under the other end 34*b* of the lever, enabling opening of the gas-valve and simultaneously releasing the locking pin 150*c* jamming the striking wheel: At this point, the locking pin leans against the protrusion 34*c*, which in a preferred embodiment has a triangular cross-section, in order to maintain the clearance of the portion 150*y* from under the other end 34*b* of the lever 34, until the lever is press to open valve 32.

When pressing the lever, the valve 32 opens. When the lever is released thereafter, the spring 38 immediately urges return of the valve 32 in the close position, followed by a quick return of the interfering piece 150 into the jamming position, urged by spring 38: the lever 34 with the protrusion 34*c*, moving from the side of the lever against the protrusion 34*c*, to under the locking pin 150*c*, to jam the lever.

Figure 15B:
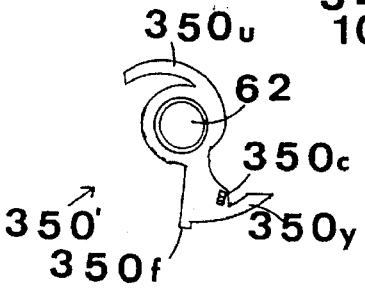
FIG. 15*b* is a top view of still another interfering piece.
Figure 15A:
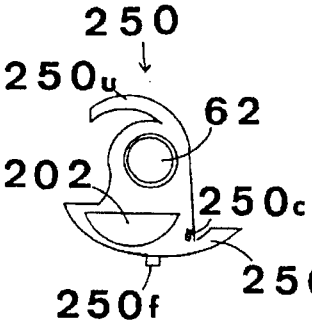
FIG. 15*a* is a top view of another interfering piece.

As shown in FIG. 15*a*, the interfering piece 250, has a portion 250*y*, for jamming the lever 34, by sliding thereunder the other end 34*b* of the lever 34, a locking pin 250*c* acting as a braking arm for jamming or braking the striker wheel, when the lighter has a striking wheel and also to operate on the protrusion 34*c* as described in the immediate above paragraph, a cut-out portion 202, a push-button 250*f*, but no spring since a resilient arm 250*u*, acts as the spring 52, biassing the interfering piece 250 in the direction for jamming the lever toward the close position. In a particular embodiment, the interfering piece 250*u* is integral with the interfering piece 250, and is plastic made. Preferably, the interfering piece 250 is provided with a locking pin 250*c*, similar to 50*c* of FIG. 10, when the lighter has a striking wheel and for acting with the protrusion 34*c* as already discussed above.

As shown in FIG. 15*b*, the interfering piece 350, has a resilient arm 350*u*, acting as the spring 52, for biassing the interfering piece 350 in the direction for jamming the lever toward the close position, a locking pin 350*c* acting as a braking arm for jamming or braking the striker wheel, when the lighter has a striking wheel and for cooperating with the protrusion 34*c*, a push-button 350*f*, a locking pin 350*c* for locking a striking wheel and a portion 350*y*, for jamming the lever 34. As shown from FIG. 15*b*, the interfering piece may be said to be S-shaped like, defining two arms and a central portion therebetween, a first arm being resilient and defining said biassing means, a second arm defining said portion displaceable toward said lever and said arm outwardly projected from said interference piece, and said central portion having a circular cut out portion, in order to be rotatably mounted about said outer peripheral portion of the casing for said flint.

Figure 16:
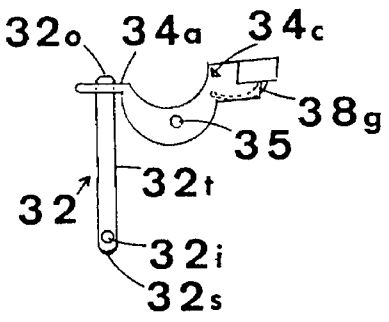
FIG. 16 is a side view of a lever having another kind of means for biassing the lever in the close position, with the gas valve.

As shown in FIG. 16, instead of a spring 38, the lever has a resilient plastic tongue 38*g* acting as a means for biassing the lever toward the close position. The lever which has a protrusion 34*c*, is connected at the one end 34*a* to the tubular member 32*t* of the valve 32, for lifting the tubular member 32*t* of the gas valve allowing the gas through the aperture 32*i*, inside the tubular member and through the central aperture 32*o*. The bottom of tubular member having the rubber seal 32*s*.

Figure 17:
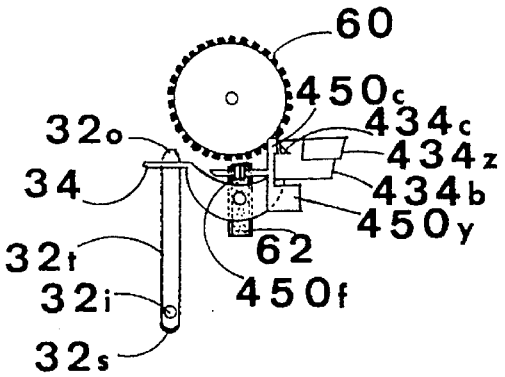
FIG. 17 is a side view of a lever, a gas valve and the striker wheel with a portion of another interfering piece.
Figure 18:
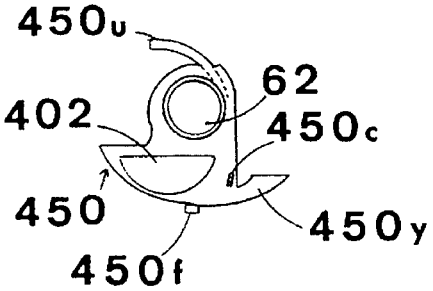
FIG. 18 is a top view of the interfering piece of FIG. 17.

In FIG. 17, the lever of FIG. 16, is combined with the ring 450 of FIG. 18, illustrating the end of the locking pin 450*c* (FIG. 10), acting as a braking arm for engaging between two adjacent teeth of a toothed striker wheel 60, in order to brake or jam or lock the striker wheel. The cross-section of that end of the locking pin 450*c*, is triangular. While the portion 450*y*, for jamming the lever 34, is under the other end 34*b* of the lever 34 for jamming it. Other parts being as already discussed.

In FIG. 18, the interfering piece 450, has a an arm 450*u* which may be either a plastic or metallic, acting as the spring 52, for biassing the interfering piece 450 in the direction for jamming the lever toward the close position, a locking pin 450*c* for jamming, blocking or locking the striker wheel, when the lighter has a striking wheel, a push-button 450*f*, a cut-out portion 402 and a portion 450*y*, for jamming the lever 34.

Figure 18A:
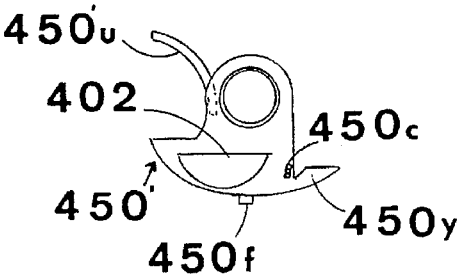
FIG. 18*a* is a top view of an interfering piece similar to FIG. 17 but having a removably mounted biassing means.

FIG. 18*a* is another interfering piece similar to FIG. 18, but where the interfering piece 450', has a removably mounted resilient arm 450'*u* which may be either a plastic or metallic, acting as the spring 52, for biassing the interfering piece 450' in the direction for jamming the lever toward the close position. Other components of that interfering piece 450', are as described in FIG. 18, for the interfering piece 450.

The pin 450*c* upwardly extends in space relation to the protrusion 434*c*, for cooperating with the protrusion 434*c*, whereby on acting against the arm 450, that portion 450*c* moves from under the striker wheel 60, dejamming or debraking or unlocking the striker wheel 60, and simultaneously the portion 450*y* from under the lever's end 434*b*. The pin 450*c*, moves on the left side of the protrusion 434*c* to enable the gap for that dejamming or debraking or unlocking. Once the lever 434 is pressed on the step-up 434*z*, the pin is released from the protrusion, and lean against the side of the lever 434 on the right hand side of the protrusion 434*c*, of FIG. 17, thereby jamming or braking or locking the striker wheel 60 and the lever 434 again.

So far we have seen an interfering piece that is so rotatably mounted, that when said interfering piece is rotated toward said one direction, said portion of said interfering piece is running under a portion of said lever, said portion of said lever being between said other end of said lever and said pivot, and superimposed over said portion of said interference piece, thereby said portion of said interference piece jamming said lever, and when said interfering piece is rotated counter to said one direction, said gap is allowed between said portion of said interfering piece and said lever, for enabling displacement of said lever.

As shown in FIG. 1, the arrows $F_1$, $F_2$ and $F_3$ indicate the positions where the portion of the interfering piece for jamming a lever may be positioned, in order to prevent displacements of the lever for opening the valve when rotating in one direction.

In the following Figures, the interfering piece is rotatably mounted, so that when said interfering piece is rotated toward said one direction, said portion of said interfering piece is running over, to be superimposed in contact against a portion of said lever, said portion of said lever, being between said one end of said lever and said pivot, and thereby jamming said lever, and when said interfering piece is rotated counter to said one direction, a gap is allowed between said portion of said interfering piece and said lever, for enabling displacement of said lever.

Figure 21:
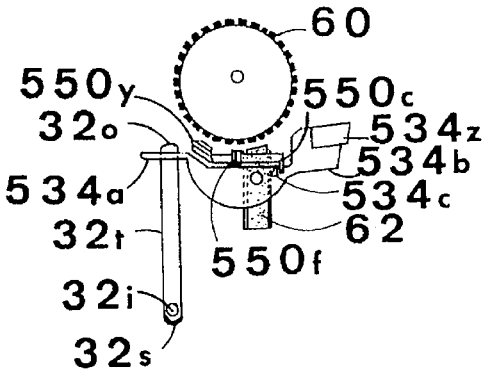
FIG. 21 is a side view of another lever, a gas valve and the striker wheel with a portion of the interfering piece of FIG. 20.
Figure 19:
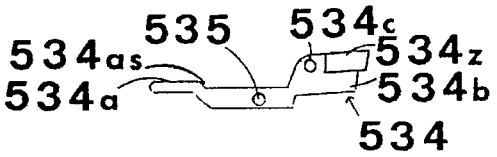
FIG. 19 is a side view of the lever of FIG. 21.

FIG. 21 particularly illustrates a $F_2$ case, where the lever 534, better shown in FIG. 19, has one end 534*a* and another end 534*b*, a rounded protrusion 534*c*, and a pivot 535. The other end 534*b* of lever 534, is step-up as shown at 534*z*. The one end 534*a*, is at a higher level than the central portion of the lever, via a shoulder 534*as* bridging the central portion to that one end.

Figure 20:
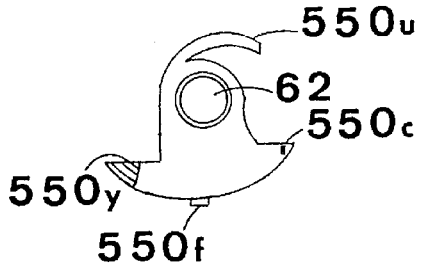
FIG. 20 is a top view of the interfering piece of FIG. 21.

The interfering piece 550, (FIGS. 20 and 21) has a an arm 550*u* acting as the spring 52, for biassing the interfering piece 550 in the direction for jamming the lever toward the close position, a push-button 550*f*, a protrusion portion 550*y* for jamming or braking or locking the striker wheel 60 as well as for jamming the end 534*a* of lever 534, by pressing against the shoulder 534*as* of the lever and thereby urging the gas valve in the close position. That portion 550*y* is folded to square fit the shoulder 534*as* of the lever as to jam it. As shown in FIG. 20, no cut-out portion is not provided. Also the portion 550*y* of the interfering piece is also acting as the braking arm of the striker wheel.

A pin 550*c* downwardly extends in space relation to the rounded protrusion 534*c*, for cooperating with the protrusion 534*c*, whereby on acting against the arm 550, that portion 550*y* moves from under the striker wheel 60, dejamming or debraking or unlocking the striker wheel 60 as well as the shoulder 534*as* of the lever's end 534*a* thereunder. The pin 550*c*, moves on the left side of the protrusion 534*c* to enable the gap for that dejamming or debraking or unlocking. Once the lever 534 is pressed on the step-up 534*z*, the pin is released from the protrusion, and lean against the side of the lever 534 on the other side of the protrusion 534*c*, thereby jamming or braking or locking the striker wheel 60 and the lever 534 again. This protrusion needs not be triangular, nor rounded but may take other shapes as desired.

As can be seen the rotation of the interfering pieces, may be accomplished in various ways and needs not be only about a spring loaded flint or about 62, or a rounded section such as 12*m*, but in any way, as long as the portion of the interfering piece is able to jam the lever when the valve is in the close position, the interfering piece being rotatably mounted on the lighter, in space relation to the lever. The interfering piece may also be mounted about a pivot, however the first two above methods are preferred, since they eliminate a component.

The interfering piece upon rotation in one direction having a portion displaceable toward said lever, for contacting said portion of said interfering piece against said lever to jam said lever, and to prevent displacements of said lever for opening said valve, when rotating in one direction, and upon rotating said interfering piece counter to said one direction, said portion of said interfering piece, being displaceable away from said lever, and said lever becoming displaceable into said open position allowing opening of said valve, thus said interfering piece being rotatably displaceable from an open unlock position to a close lock position. As shown from the drawings and in a preferred embodiment, the interfering piece and said portion of said interfering piece are parallel to a plane, and said arm outwardly projected from said interfering piece, for instance 50*c*, 150*c*, 250*c*, 350*c*, 450*c*, extending perpendicular to said plane.

It should be borne in mind that anyone of the above child-proof lighters may be part of a pen or other devices.

While some of the preferred embodiments have been described herein above, it is to be understood that the invention is not to be construed as limited to these preferred embodiments, as many modifications and variations are possible within the spirit and scope of the appended claims.

I claim:

1. A child-proof gas lighter comprising:

a gas reservoir, said gas reservoir having a gas valve, a lever having one end and another end, and a pivot therebetween said ends, in order to enable rocking of said lever, said lever defining a protrusion sideways, between one of said ends of said lever and said pivot, said protrusion having a side and another side opposite thereto, said gas valve being operatively connected to said one end of said lever, for opening and closing said gas valve in an open and close position, a means for biassing said lever toward said close position, in space relation to said gas valve, a means for igniting gas from said gas valve, an interfering piece rotatably mounted on said lighter, in space relation to said lever, said interfering piece having an arm outwardly projected from said interfering piece, said interfering piece upon rotation in one direction having a portion displaceable toward said lever, for contacting said portion of said interfering piece against said lever to jam said lever, and to prevent displacements of said lever for opening said valve, and upon rotating said interfering piece counter to said one direction, said portion of said interfering piece, being displaceable away from said lever, and said lever becoming displaceable into said open position allowing opening of said valve, and said arm of said interfering piece, extending in space relation to said protrusion sideways of said lever, for cooperating with said protrusion, whereby on acting counter to said one direction, on said interfering piece, said arm of said interfering piece moving from said lever, said arm moving on one side of the protrusion and resting against that protrusion, to enable a gap between the portion of said interfering piece and the lever, in order to enable displacement of said lever for opening of said gas valve, and upon pressing the lever for opening of said gas valve, said arm of said interfering piece is slipping from the protrusion, to lean against the side of the lever, on the other side of the protrusion, thereby jamming the lever upon return of the lever in said close position for closing said gas valve, thus said interfering piece being rotatably displaceable from an open unlock position toward a close lock position each time that the lever is press for opening of said gas, a means for biassing said interfering piece toward said one direction, to induce rotation of said interfering piece toward said one direction.

2. The child-proof gas lighter, as defined in claim 1, wherein said means for igniting gas from said gas valve, is a spring loaded flint in a casing having an outer circular peripheral portion, and a striker wheel for actuating said flint, and said interfering piece has a circular cut out portion, in order to be rotatably mounted about said outer peripheral portion of said casing for said flint.

3. The child-proof gas lighter, as defined in claim 1, wherein said interfering piece is rotatably mounted, so that when said interfering piece is rotated toward said one direction, said portion of said interfering piece is running under a portion of said lever, said portion of said lever being between said other end of said lever and said pivot, and superimposed over said portion of said interference piece, thereby said portion of said interference piece jamming said lever, and when said interfering piece is rotated counter to said one direction, said gap is allowed between said portion of said interfering piece and said lever, for enabling displacement of said lever.

4. The child-proof gas lighter, as defined in claim 1, wherein said interfering piece is rotatably mounted so that when said interfering piece is rotated toward said one direction, said portion of said interfering piece is running over, to be superimposed in contact against a portion of said lever, said portion of said lever, being between said one end of said lever and said pivot, and thereby jamming said lever, and when said interfering piece is rotated counter to said one direction, a gap is allowed between said portion of said interfering piece and said lever, for enabling displacement of said lever.

5. The child-proof gas lighter, as defined in claim 1, wherein said means for igniting gas from said gas valve, is a spring loaded flint in a casing having an outer circular peripheral portion, and a striker wheel for actuating said flint, and said interfering piece has a circular cut out portion, in order to be rotatably mounted about said outer peripheral portion of said casing for said flint, said interfering piece defining a segment-like of a flattened circular area bounded by a chord and a flattened arc of that circular area, and said circular cut out portion being off-center and diametrically opposed to said segment, said segment having one end defined by said arc and said chord, said one end defining said portion of said interfering piece.

6. The child-proof gas lighter, as defined in claim 1, wherein said means for igniting gas from said gas valve, is a spring loaded flint, and a striker wheel for actuating said flint, for igniting gas from said gas valve, said interfering piece further includes a braking arm outwardly projected from said interfering piece, and in space relation to said striker wheel for releasably holding said striker wheel, whereby when moving in said one direction, said interfering piece simultaneously jams said lever, preventing displacements of said lever for opening said valve, and brakes said striker wheel, and upon moving said interfering piece counter to said direction, said portion of said interfering piece, being displaceable away from said lever, said lever being displaceable in said open position, to allow opening of said valve, and actuation of said striker wheel.

7. The child-proof gas lighter, as defined in claim 1, wherein said means for igniting gas from said gas valve, is a spring loaded flint, and a striker wheel for actuating said flint, for igniting gas from said gas valve, said interfering piece further includes a braking arm outwardly projected from said interfering piece, and in space relation to said striker wheel for releasably holding said striker wheel, whereby when moving in said one direction, said interfering piece simultaneously jams said lever, preventing displacements of said lever for opening said valve, and brakes said striker wheel, and upon moving said interfering piece counter to said direction, said portion of said interfering piece, being displaceable away from said lever, said lever being displaceable in said open position, to allow opening of said valve, and actuation of said striker wheel, said braking arm being defined by an extension of said arm outwardly projected from said interfering piece.

8. The child-proof gas lighter, as defined in claim 1, wherein said lever is defining said protrusion sideways, between said other end and said pivot of said lever, said arm being enlarged adjacent to said protrusion of said lever as to define an enlarged portion, whereby on acting counter to said one direction on said interfering piece, said enlarged portion of said arm, moves against one side of the protrusion to enable a gap between the portion of said interfering piece and the lever, and upon pressing the lever for opening said gas valve, the protrusion slides away from the enlarged portion of said arm, the enlarged portion of said arm of said interfering piece, is thus released from the protrusion, to lean against the side of the lever, on said other side of the protrusion, thereby ready for jamming the lever when the lever returns to the close position.

9. The child-proof gas lighter, as defined in claim 8, wherein said arm is a pin, said pin ending into an end having an enlarged width defining said enlarged portion, for contacting one side of the protrusion upon turning the interference piece counter to said one direction.

10. The child-proof gas lighter, as defined in claim 1, wherein said interfering piece and said portion of said interfering piece are parallel to a plane and said arm outwardly projected from said interfering piece extending perpendicular to said plane.

11. The child-proof gas lighter, as defined in claim 1, wherein said interfering piece is a locking, open ring rotatably mounted, in space relation to said lever, and said portion of said interference piece, is a segment end of said ring for engaging under said other end of said lever.

12. The child-proof gas lighter, as defined in claim 1, wherein said interfering piece is a locking, open ring rotatably mounted, in space relation to said lever, for locking said lever, and said portion is a segment end of said ring for engaging under said other end of said lever for locking, said open ring is provided with a corresponding projection, said projection acting as said arm outwardly projected from said interfering piece, and said projection having an enlarged portion for engaging against said protrusion sideways provided on said lever.

13. The child-proof gas lighter, as defined in claim 1, wherein said means for igniting gas from said gas valve, is a spring loaded flint, and a striker wheel for actuating said flint, for igniting gas from said gas valve, said interfering piece further includes a braking arm outwardly projected from said interfering piece, and in space relation to said striker wheel for releasably holding said striker wheel, whereby when moving in said one direction, said interfering piece simultaneously jams said lever, preventing displacements of said lever for opening said valve, and brakes said striker wheel, and upon moving said interfering piece counter to said direction, said portion of said interfering piece, being displaceable away from said lever, said lever being displaceable in said open position, to allow opening of said valve, and actuation of said striker wheel, said braking arm and said arm outwardly projected from said interfering piece, being each independently mounted on said interfering piece.

14. The child-proof gas lighter, as defined in claim 1, wherein said means for igniting gas from said gas valve, is a spring loaded flint in a casing having an outer circular peripheral portion, and a striker wheel for actuating said flint, said striker wheel is toothed, said protrusion of said lever is a V-shaped protrusion, said arm outwardly projected is provided with a projection having a V-shaped enlargement, said V-shaped enlargement for engaging against the V-shaped protrusion of said lever, in order to ensure clearance of the lever from said portion of said interference piece, for the passage of the lever, in said unlock position, and said projection having a V-shaped enlargement, further extending for engaging between two adjacent teeth of said toothed striker wheel, in order to lock the striker wheel, when the spring-loaded, locking, open ring is in the close lock position.

15. The child-proof gas lighter, as defined in claim 1, wherein said interfering piece is a resilient material, and said biassing means is an arm defined in said interfering piece and integral with said interfering piece.

16. The gas lighter, as defined in claim 1, wherein said means for igniting gas from said gas valve, is a spring loaded flint in a casing having an outer circular peripheral portion, and a striker wheel for actuating said flint, and said interfering piece said interfering piece is S-shaped like, defining two arms and a central portion therebetween, a first arm being resilient and defining said biassing means, a second arm defining said portion displaceable toward said lever and said arm outwardly projected from said interference piece, and said central portion having a circular cut out portion, in order to be rotatably mounted about said outer peripheral portion of said casing for said flint.

17. The child-proof gas lighter, as defined in claim 1, wherein said lever defines a longitudinal side having an uppermost portion, said protrusion sideways of said lever is between said other end of said lever and said pivot on said uppermost portion of said longitudinal side, said means for igniting gas from said gas valve, is a spring loaded flint, and a striker wheel for actuating said flint, said flint having an axis of symmetry, said interfering piece is rotatably mounted so as to be coaxial with said flint, and said interfering piece further includes a braking arm outwardly projected from said interfering piece, and in space relation to said striker wheel for releasably holding said striker wheel, thus when said interfering piece is moving, in said one direction, said interfering piece simultaneously jams said lever, and brakes said striker wheel, and upon moving said interfering piece counter to said direction, said lever becomes displaceable in said open position, to allow opening of said valve, and actuation of said striker wheel, said lever defining a protrusion sideways, between said other end and said pivot of said lever, and said braking arm extending in space relation to the protrusion, for cooperating with the protrusion, whereby on acting counter to said one direction, on said interfering piece, said braking arm moves from the striker wheel and from the lever, the braking arm moving on one side of the protrusion to enable a gap between the portion of said interfering piece and the lever, in order to enable displacement of said lever for opening of said gas valve, and upon pressing the lever for opening of said gas valve, the braking arm is released from the protrusion, to lean against the side of the lever, on the other side of the protrusion, thereby jamming the striker wheel and the lever.

18. A child-proof gas lighter comprising:

a gas reservoir, said gas reservoir having a gas valve, a spring-loaded lever having one end and another end, said gas valve being operatively connected to one end of said spring-loaded lever, pivotally connected to the other end of said spring-loaded lever, a pen-clip having a top, said spring of said spring-loaded lever urging closing of said gas valve, a spring-loaded, locking, open ring rotatably mounted over a portion of said pen-clip, and covering a portion of said pen-clip, as to prevent sliding of said pen-clip for opening said gas valve, upon rotation of said spring-loaded, locking, open ring, the open portion of said ring being able to be in phase over said portion of said pen-clip, in order to allow the pen-clip through to allow opening of said gas valve, the spring of said spring-loaded, locking, open ring urging positioning of the open portion of said open ring out of phase with said portion of said pen-clip, as to be in a lock position, whereby on turning the spring-loaded, locking, open ring to align that open portion, with the pen-clip, the pen-clip becomes displaceable in that open portion of the spring-loaded, locking, open ring, to open the gas valve, once the pen-clip is actuated to close the gas-valve, the spring-loaded, locking, open ring is urged to return to said lock position, by said spring of said spring-loaded, locking, open ring, adjacent to said gas valve, a rotatably mounted striker wheel is operatively connected to a spring loaded flint, said lever being provided with a protrusion, and said spring-loaded, locking, open ring being provided with a projection for engaging said protrusion of said spring loaded lever, in order to ensure clearance of the ends of the spring-loaded, locking, open ring, for the passage of the pen-clip.

19. The child-proof gas lighter, as defined in claim 18, wherein said striker wheel is toothed, said projection having an enlarged portion for engaging against said protrusion of said lever, in order to ensure clearance of the ends of the spring-loaded, locking, open ring, for the passage of the top of the pen-clip, said projection terminating into a free end for engaging between two adjacent teeth of said toothed striker wheel, in order to lock the striker wheel, when the spring-loaded, locking, open ring is in the lock position, and to simultaneously unlock the striker wheel and the lever upon said rotation of said spring-loaded, locking, open ring, in order to allow the pen-clip through to allow opening of said gas valve.

20. The child-proof gas lighter, as defined in claim 18, wherein said protrusion of said lever is a V-shaped protrusion, said projection of said spring-loaded, locking, open ring is a projection having a V-shaped enlargement, for engaging against said V-shaped protrusion of said spring loaded lever, in order to ensure clearance of the ends of the spring-loaded, locking, open ring, for the passage of the top of the pen-clip.

* * * * *